United States Patent [19]

DeBoe

[11] Patent Number: 5,056,693

[45] Date of Patent: Oct. 15, 1991

[54] GARMENT HANGER FOR WETSUIT WITH REMOVABLE DRYING RODS

[76] Inventor: Thomas S. DeBoe, 17320 Evangeline La., Olney, Md. 20832

[21] Appl. No.: 524,504

[22] Filed: May 17, 1990

[51] Int. Cl.[5] ..... A47G 25/38

[52] U.S. Cl. ..... 223/88; 223/92; 223/85

[58] Field of Search ..... 223/85, 88, 92, 69; 211/113, 115; 248/339, 340; D6/315, 328

[56] References Cited

U.S. PATENT DOCUMENTS

| | | | |
|---|---|---|---|
| D. 239,089 | 3/1976 | Gindi | D6/8 |
| D. 272,792 | 2/1984 | Marx | D6/248 |
| 1,591,786 | 7/1926 | Simpson | 223/88 |
| 2,114,803 | 4/1938 | Kurucz et al. | 223/88 |
| 2,198,768 | 4/1940 | Goldman | 223/88 |
| 2,298,491 | 10/1942 | Lamar | 223/88 |
| 2,472,262 | 6/1949 | Mullen | 223/89 |
| 3,207,392 | 10/1965 | Ericson | 223/85 |
| 3,358,891 | 12/1967 | Roule | 223/88 |
| 3,419,239 | 12/1968 | Ginther | 211/113 |
| 3,517,823 | 6/1970 | Papineau | 223/88 |
| 4,424,922 | 1/1984 | Zuckerman et al. | 223/88 |
| 4,768,657 | 9/1988 | Lonow | 211/113 |

FOREIGN PATENT DOCUMENTS

| | | | |
|---|---|---|---|
| 3621753 | 7/1988 | Fed. Rep. of Germany | 223/85 |

*Primary Examiner*—Werner H. Schroeder
*Assistant Examiner*—Bibhu Mohanty
*Attorney, Agent, or Firm*—Donald A. Kettlestrings

[57] ABSTRACT

A garment drying hanger includes a body member slidably receiving an adjustable hook member therein and defining a plurality of openings for removably receiving a plurality of rods upon which wet surf boots, surf gloves and the like can be positioned for drying. A cage-like structure, substantially in the shape of human shoulders, is attached to and is suspended beneath the body member for supporting a scuba wet suit or the like in a position for drying, and the rods can be stored within the cage-like structure when the rods are not in use.

16 Claims, 3 Drawing Sheets

34
16
20
24

56
58
60
26
24
62
18
42
36
40

GARMENT HANGER FOR WETSUIT WITH REMOVABLE DRYING RODS

FIELD OF THE INVENTION

This invention relates to a garment drying hanger and more particularly to such a hanger for drying scuba wet suits and wet suit accessories, such as gloves and boots.

SUMMARY OF THE INVENTION

An object of the present invention is the provision of a garment drying hanger.

Another object is to provide such a hanger for drying scuba wet suits.

A further object of the invention is the provision of such a garment drying hanger which also is adapted to dry wet surf boots, surf gloves and the like.

Still another object is to provide such a garment drying hanger which is shaped to allow for improved air flow through the wet suit.

A still further object is to provide such a garment drying hanger which is shaped to keep the front of the wet suit from collapsing onto the back as the wet suit is hung from the hanger.

Still another object is to provide such a garment drying hanger which decreases the time required for drying wet suits.

Another object is to provide such a hanger which incorporates an adjustable hook member for enabling the hook member to be adjustably positioned with respect to the hanger.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

The accompanying drawings, which are incorporated in and constitute a part of this specification, illustrate an example of a preferred embodiment of the invention and, together with the description, serve to explain the principles of the invention.

DESCRIPTION OF THE PREFERRED EMBODIMENTS

Figure 1:
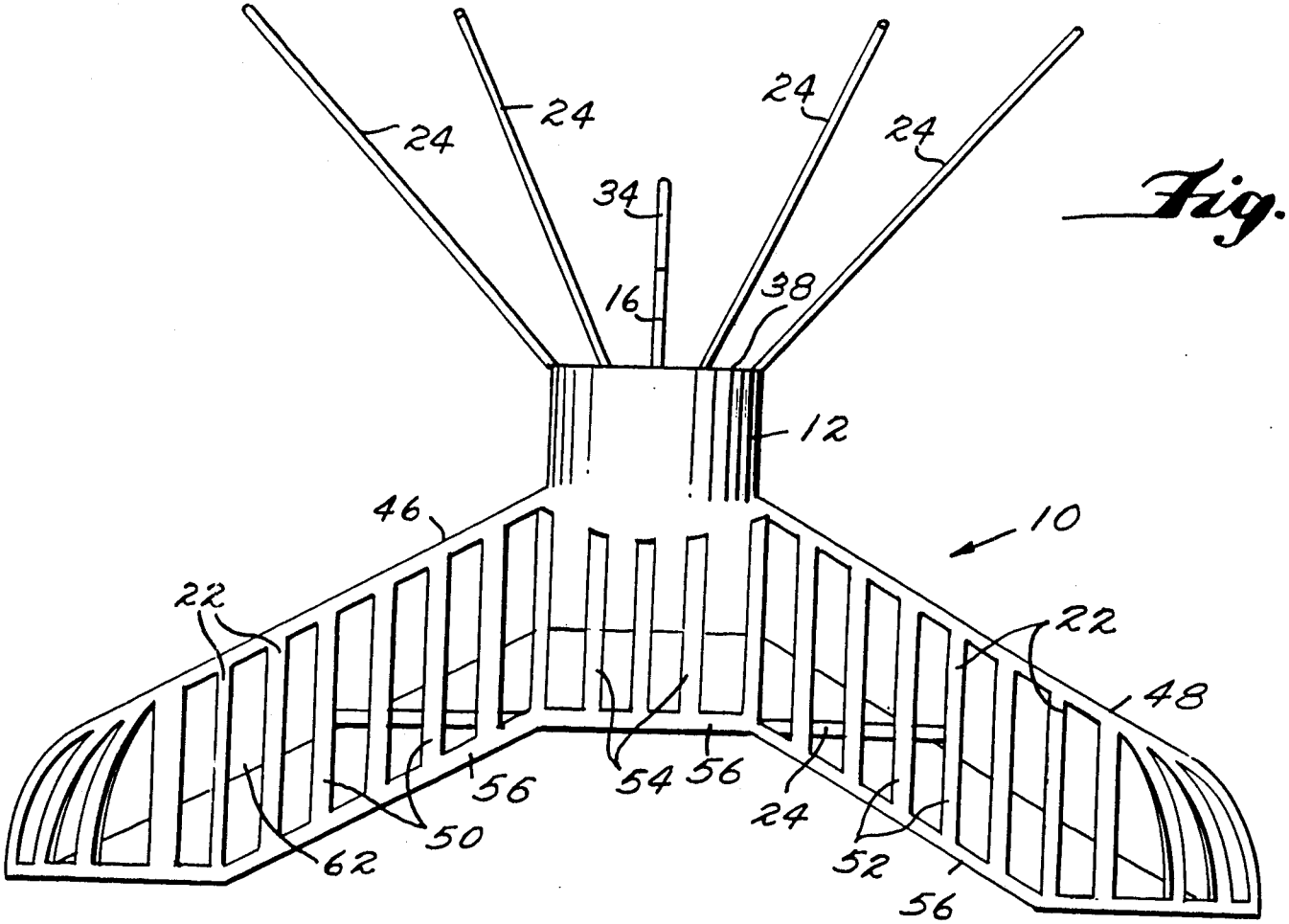
FIG. 1 is a front elevation view of the hanger showing four of five rods inserted into positions within a body member of the hanger.
Figure 2:
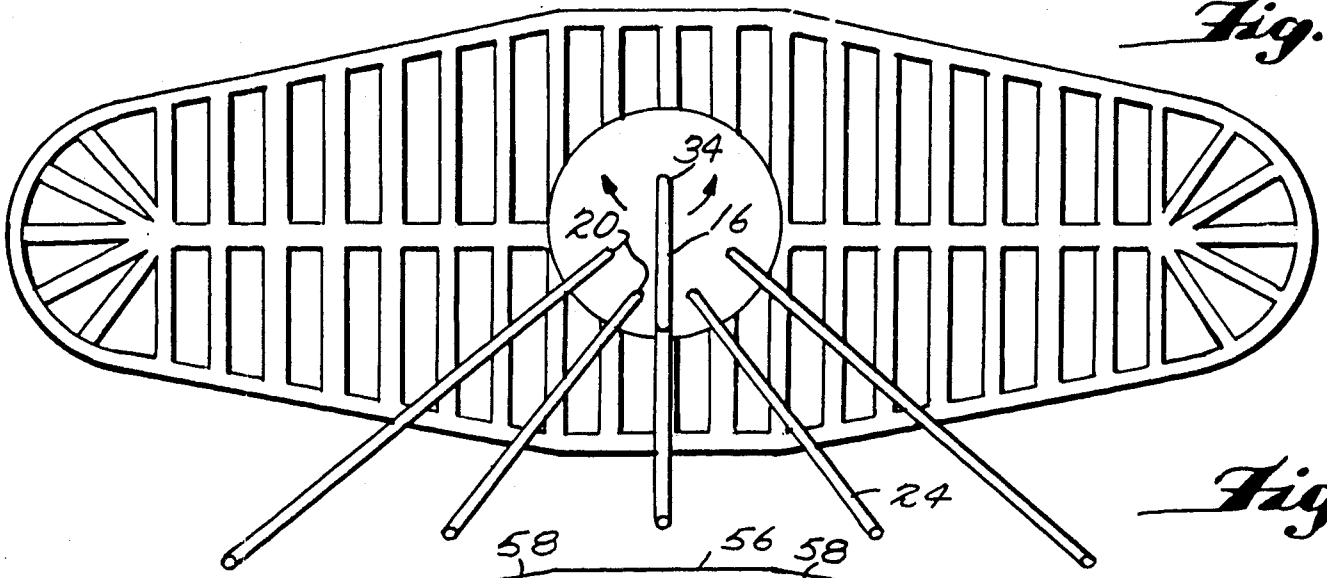
FIG. 2 is a top plan view of the hanger showing five rods inserted into positions within the body member of the hanger.
Figure 3:
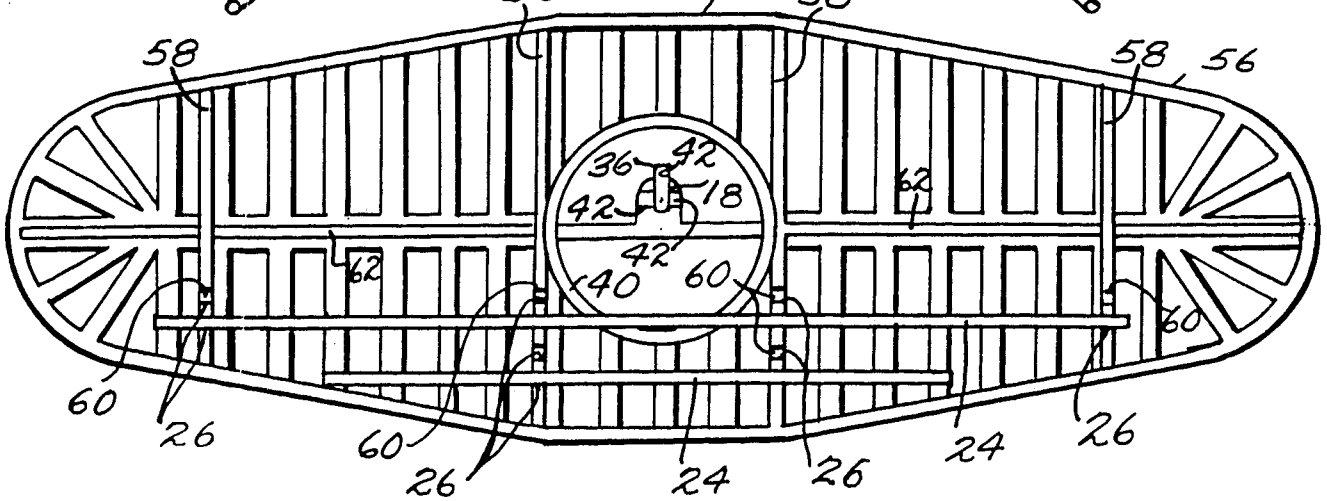
FIG. 3 is a bottom plan view of the hanger showing two rods in storage positions.
Figure 4:
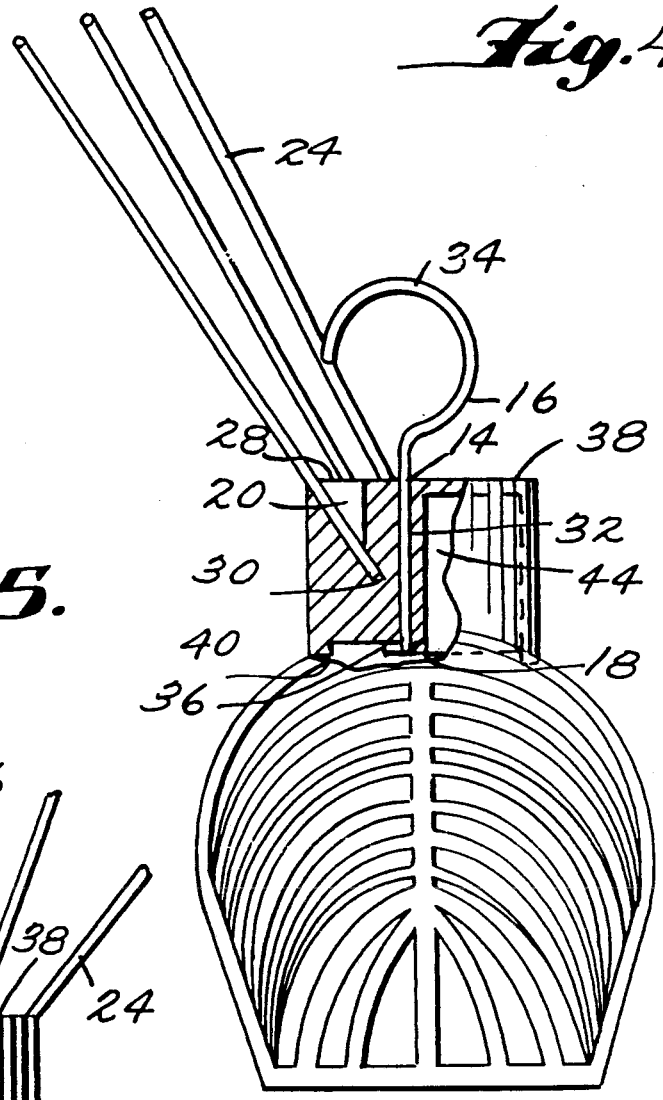
FIG. 4 is an end elevation view of the hanger, partly in fragment, showing three rod members inserted into positions within the body member of the hanger.
Figure 5:
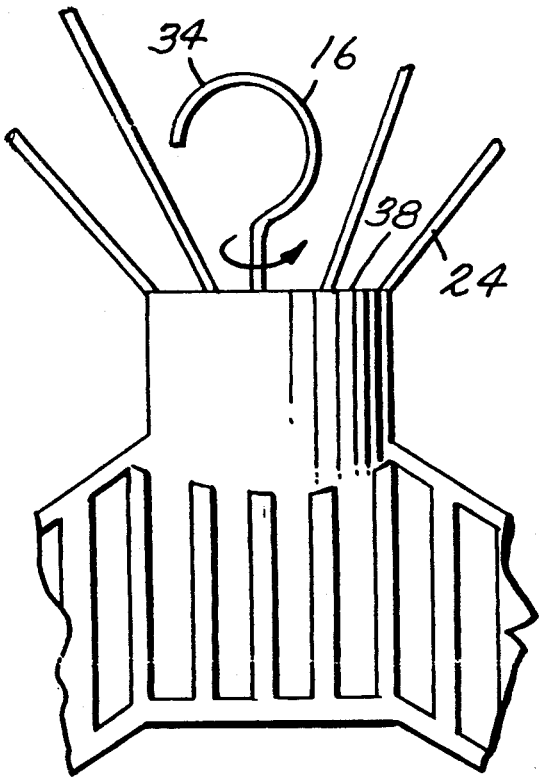
FIG. 5 is a fragmentary front elevation view showing the hook member of the hanger in a different position than that shown in FIG. 1.

With reference now to the drawings, wherein like reference characters designate like or corresponding parts throughout the several views, there is shown a garment drying hanger 10 which includes a body member 12 defining a first substantially normally vertical opening 14.

A hook member 16 is slidably positioned within opening 14 and projects above body member 12 for removably suspending hanger 10 from a conventional support.

Means 18 are provided in operative relationship with hook member 16 and with body member 12 for retaining hook member 16 within opening 14.

Body member 12 further defines a plurality of second openings 20, and a cage-like structure 22, substantially in the shape of human shoulders, is attached to and suspended beneath body member 12.

In accordance with the invention, a plurality of rods 24 are provided for selective insertion into and removal from openings 20, and means 26 are provided in operative relationship with cage-like structure 22 for holding and storing rods 24 when the rods are not in use.

Each of openings 20 defines a passageway having an open upper end 28 and a closed lower end 30. Hook member 16 defines an elongated central portion 32, and a first hook 34 is attached to a first end of central portion 32. A second hook-like element 36 is attached to a second end of central portion 32 and projects in substantially the same direction from central portion 32 as first hook 34. Hook-like element 36 projects substantially at an angle of ninety degrees from central portion 32.

Body member 12 defines a first upper surface 38 and an opposed second lower surface 40, and opening 14 extends through body member 12 between surfaces 38 and 40.

Preferably, retaining means 18 include a plurality of notches 42 within surface 40 for removably receiving and retaining hook-like element 36. Hook member 16 can be pushed downwardly so that central portion 32 slidably moves through opening 14. Hook member 16 can then be rotated to a desired position, and hook member 16 can then be raised so that hook-like element 36 engages one of notches 42. The weight of body member 12, cage-like structure 22 and the garment positioned on the hanger will cause hook-like element 36 to remain within the selected notch 42. The position of hook member 16 with respect to body member 12 can always be adjusted in the manner described so that the orientation or alignment of hook 34 can be adjusted to any desired position with respect to body member 12 and with respect to cage-like structure 22.

Open upper ends 28 of each of openings 20 are contiguous with upper surface 38 of body 12, and open upper end 28 within each opening or passageway 20 is preferably larger than closed lower end 30 for accommodating easy insertion of rods 24 into and removal of the rods from openings or passageways 20.

Vertical opening 14 is preferably eccentrically located within body member 12 for enabling hanger 10 to be suspended in a balanced position when a wet suit or other garment is suspended from the hanger and when gloves and boots are positioned on rods 24 inserted into passageways 20 during the drying process.

In accordance with the invention, each of openings or passageways 20 are positioned within body member 12 to be oriented between vertical and horizontal when hanger 10 is suspended from a conventional support. This allows rods 24 to project from openings 20 at an angle of substantially forty-five degrees, for example, with respect to horizontal so that gloves and boots positioned on the rods during drying are located away from hook member 16 and in positions to be securely retained on rods 24.

Body member 12 is typically substantially cylindrically shaped, and a hollow portion 44 may typically be provided within the interior of body member 12 to reduce the amount of material required for the manufacture of the body member.

Cage-like structure 22 preferably includes a first bar member 46 attached to and projecting normally downwardly and away from body member 12. A second bar member 48 is attached to and projects normally downwardly and away from body member 12. Bar members 46 and 48 are positioned in substantially planar alignment with each other and project from body member 12 in substantially opposite directions from each other.

A first plurality of rib members 50 are attached to and extend normally downwardly from first bar member 46, and a second plurality of rib members 52 are attached to and extend normally downwardly from second bar member 48. A third plurality of rib members 54 are attached to and extend normally downwardly from body member 12, and a ring member 56 is attached to and connects together all of rib members 50, 52 and 54.

Holding and storing means 26 preferably include a plurality of substantially parallel supporting members 58 which are attached to and extend between predetermined of rib members 50, 52 and 54, and supporting members 58 define notches 60 therein for holding and storing rods 24.

The span or distance between free ends of each of first plurality of rib members 50 decreases as each of rib members 50 is positioned farther along first bar member 46 from body member 12. Similarly, the span of each of rib members 52 decreases as each of rib members 52 is positioned farther along second bar member 48 from body member 12. The span of each of rib members 54 is substantially the same for each of rib members 54. As a result, bar members 46, 48 and rib members 50, 52 are, in combination, substantially in the shape of human shoulders.

A substantially planar element 62 is attached to and projects normally beneath body member 12 and beneath bar members 46, 48 for providing structural rigidity to cage-like structure 22.

In use, rods 24 are removed from notches 60 and are inserted into openings or passageways 20. Hook member 16 is adjusted within opening 14 so that hook member 16 is oriented in the desired direction with respect to body member 12 and with respect to cage-like structure 22. A garment, such as a scuba wet suit, is then positioned onto cage-like structure 22. Because cage-like structure 22 is shaped similarly to human shoulders, the weight of the wet suit or other garment is distributed to alleviate stress in the wet suit material, thereby extending the life of the suit. The configuration of cage-like structure 22 also provides the advantage of keeping the front of the wet suit from collapsing onto the back. This allows for improved air flow through the suit and shortens the required drying time.

Wet surf boots, surf gloves or the like can simultaneously be positioned onto the upper ends of rods 24, which are projecting upwardly and outwardly from passageways 20. When the garment and accessories have dried, the surf boots, gloves or other accessory items can be removed from rods 24. The rods can then be removed from passageways 20, and the rods can then be reinserted and snapped into position within notches 60.

The adjustable feature of hook member 16 allows the hook member to be positioned substantially at ninety degrees with respect to the plane defined by bar members 46 and 48 when the wet suit and accessories are being dried. This enables the hanger to be suspended beneath a shower rod, for example, so that rods 24 do not project upwardly in interference with the shower rod. After the suit and accessories have been dried, rods 24 can be returned to their storage positions within notches 60. Hook member 16 can then be adjusted to be repositioned in substantially parallel relationship with the plane defined by bar members 46 and 48. This enables the hanger to be hung in a closet or other space with the orientation of a conventional hanger.

The invention in its broader aspects is not limited to the specific details shown and described, and departures may be made from such details without departing from the principles of the invention and without sacrificing its chief advantages.

I claim:

1. A garment drying hanger comprising:

a body member defining a first substantially normally vertical opening;

a hook member positioned within said opening and projecting above said body member for removably suspending said hanger from a conventional support;

means in operative relationship with said hook member and with said body member for retaining said hook member within said opening;

said body member further defining a plurality of second openings;

a cage-like structure substantially in the shape of human shoulders attached to and suspended beneath said body member;

a plurality of rods for selective insertion into said second openings; and means in operative relationship with said cage-like structure for holding and storing said rods.

2. A hanger as in claim 1 wherein each of said second openings defines a passageway having an open upper end and a closed lower end.

3. A hanger as in claim 2 wherein said hook member defines an elongated central portion, a first hook attached to a first end of said central portion and a second hook-like element attached to a second end of said central portion.

4. A hanger as in claim 3 wherein said body member defines a first upper surface and an opposed second lower surface and wherein said first opening extends through said body member between said first surface and said second surface.

5. A hanger as in claim 4 wherein said retaining means include a plurality of notches on said second surface for removably receiving and retaining said second hook-like element.

6. A hanger as in claim 5 wherein said open upper ends are contiguous with said first upper surface.

7. A hanger as in claim 6 wherein said open upper end within each said passageway is larger than said closed lower end in said passageway for accommodating easy insertion of said rods into and removal of said rods from said passageways.

8. A hanger as in claim 7 wherein said first vertical opening is eccentrically located within said body member.

9. A hanger as in claim 8 wherein said passageways are each positioned within said body member to be oriented between vertical and horizontal when said hanger is suspended from said conventional support.

10. A hanger as in claim 9 wherein said body member is substantially cylindrically shaped.

11. A hanger as in claim 10 wherein said hook member is slidably positioned within said first vertical opening.

12. A hanger as in claim 1 wherein said cage-like structure includes:

a first bar member attached to and projecting normally downwardly and away from said body member;

a second bar member attached to and projecting normally downwardly and away from said body member;

said first bar and said second bar positioned in substantially planar alignment with each other;

a first plurality of rib members attached to and extending normally downwardly from said first bar member;

a second plurality of rib members attached to and extending normally downwardly from said second bar member;

a third plurality of rib members attached to and extending normally downwardly from said body member;

a ring member attached to and connecting together all of said rib members; and said holding and storing means including a plurality of substantially parallel supporting members attached to and extending between predetermined of said rib members, said supporting members defining notches therein for holding and storing said rods.

13. A hanger as in claim 12 wherein the span of each of said first plurality of rib members decreases as each of said first plurality of rib members is positioned farther along said first bar member from said body member and wherein the span of each of said second plurality of rib members decreases as each of said second plurality of rib members is positioned farther along said second bar member from said body member.

14. A hanger as in claim 13 wherein the span of each of said third plurality of rib members is substantially the same.

15. A hanger as in claim 14 wherein said first bar member, said second bar member, said first plurality of rib members and said second plurality of rib members are in combination substantially in the shape of human shoulders.

16. A hanger as in claim 15 further including a substantially planar element attached to and projecting normally beneath said body member, said first bar member and said second bar member for providing structural rigidity to said cage-like structure.

* * * * *